US006961531B2

(12) United States Patent
Hoobing

(10) Patent No.: US 6,961,531 B2
(45) Date of Patent: Nov. 1, 2005

(54) REFILLABLE PRINT CARTRIDGE AND METHOD OF REFILLING

(75) Inventor: Alecia Dawn Hoobing, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 93 days.

(21) Appl. No.: 10/274,091

(22) Filed: Oct. 17, 2002

(65) Prior Publication Data

US 2004/0076453 A1 Apr. 22, 2004

(51) Int. Cl.[7] ..... G03G 15/08
(52) U.S. Cl. ..... 399/258; 399/262
(58) Field of Search ..... 399/258, 259, 399/251, 262, 263, 237, 111, 119, 120; 222/DIG. 1, 146.2, 146.5; 347/86

(56) References Cited

U.S. PATENT DOCUMENTS

| | | | | | |
|---|---|---|---|---|---|
| 3,854,224 | A | * | 12/1974 | Yamaji et al. | 34/77 |
| 4,816,877 | A | | 3/1989 | Keen | |
| 5,110,646 | A | | 5/1992 | Prestel et al. | |
| 5,422,976 | A | * | 6/1995 | Knepler | 392/451 |
| 5,528,349 | A | * | 6/1996 | Satake | 399/262 |
| 5,561,507 | A | * | 10/1996 | Shelffo et al. | 399/237 |
| 5,594,535 | A | | 1/1997 | Beaufort et al. | |
| 5,758,224 | A | | 5/1998 | Binder et al. | |
| 5,802,435 | A | | 9/1998 | Trask et al. | |
| 5,839,028 | A | | 11/1998 | Nomura et al. | |
| 6,164,765 | A | * | 12/2000 | Sato et al. | 347/85 |
| 6,381,433 | B1 | * | 4/2002 | Sakai | 399/250 |
| 6,435,676 | B1 | * | 8/2002 | Murray et al. | 347/87 |
| 6,627,374 | B2 | * | 9/2003 | Fumita et al. | 430/137.17 |

FOREIGN PATENT DOCUMENTS

| | | | | |
|---|---|---|---|---|
| JP | 59042567 | A | * 3/1984 | G03G/15/08 |
| JP | 01302270 | A | * 12/1989 | G03G/9/08 |
| JP | 02173666 | A | * 7/1990 | G03G/9/087 |
| JP | 07253688 | A | * 10/1995 | G03G/9/13 |
| JP | 09166910 | A | * 6/1997 | G03G/15/08 |
| JP | 2002196537 | A | * 7/2002 | G03G/9/087 |

* cited by examiner

*Primary Examiner*—Robert Beatty

(57) ABSTRACT

A printer cartridge for an image forming apparatus includes a cartridge body having a refillable reservoir and a heater mechanism. The refillable reservoir is adapted to receive developer particles suspended in a fluid medium. The heater mechanism heats the refillable reservoir to evaporate the fluid medium from the refillable reservoir leaving the developer particles behind.

29 Claims, 4 Drawing Sheets

REFILLABLE PRINT CARTRIDGE AND METHOD OF REFILLING

TECHNICAL FIELD

This invention relates to refillable toner cartridges used in electrophotographic imaging systems, and processes for refilling the toner cartridge.

BACKGROUND OF THE INVENTION

Many image forming apparatus, such as laser printers, copy machines and facsimile machines, utilize electrophotographic printing processes for producing images and text on media. In general, these electrophotographic printing processes involve first charging a photoreceptor which is a roller (i.e., drum) or a continuous belt bearing a photoconductive material. Next, the charged area of the photoreceptor is exposed to a light image of the text and/or image to be reproduced to produce an electrostatic charge on the charged area in the shape of the image and/or text. Developer particles (i.e., toner) are then presented to the photoreceptor so that the particles are transferred to the charged area in the shape of the image and/or text. Next, the toner particles are transferred, in the shape of the image and/or text to be reproduced, from the photoreceptor to the media. These toner particles on the media are then fixed or fused to the media. Lastly, the photoreceptor is cleaned or restored to be made ready for the next printing cycle.

As described above, electrophotographic printing processes use toner to print or copy the desired image and/or text onto media. This toner is a powdery substance made up of polymer based toner particles, with each toner particle typically having a diameter of less than five microns. The toner is contained within a toner hopper (i.e., reservoir) of a removable toner cartridge. Generally, the toner cartridge also includes the photoreceptor, a charging assembly for charging the photoreceptor, a developing assembly for transferring the toner from the toner hopper to the photoreceptor and a cleaning assembly for restoring the photoreceptor for the next printing cycle. Since the electrophotographic printing process consumes toner, the toner cartridge must be replaced or the toner hopper of the toner cartridge must be refilled once the toner is exhausted. Unfortunately, since the toner cartridge includes the photoreceptor, charging assembly, developing assembly and the cleaning assembly, the toner cartridge design is relatively expensive. In addition, the photoreceptor, charging assembly, developing assembly and the cleaning assembly last considerably longer than the amount of toner contained within the toner hopper. Thus, the disposal of the entire toner cartridge results in unnecessary waste of material and landfill space with the costs being passed on to the consumer.

The process of refilling the toner hopper has also presented drawbacks, since the refilling process proven to be difficult and messy. Since the toner is a fine powdery substance, it tends to spill over the components of the toner cartridge. In addition, the toner tends to linger in the air and to adhere to the clothes of the individual who is refilling the cartridge. Excess toner on the photoreceptor as a result of the filling process can cause blotching, streaking or voiding of prints and copies produced by the electrophotographic printing process. Moreover, toner spillage on moving parts of the toner cartridge can cause the moving parts to wear out more rapidly and may even short out the electrical components in the cartridge. As such, toner spillage as a result of the refilling process can reduce the quality of prints and copies, increase maintenance cost, and can even decrease the useful life of the image forming apparatus.

There is a need for improved refillable toner cartridges and methods of refilling the toner cartridge with toner. In particular there is a need for an improved refillable toner cartridge that can be refilled with toner using a refill method that minimizes toner spillage and the attendant drawbacks associated therewith.

SUMMARY OF THE INVENTION

In one embodiment, the present invention is a printer cartridge for an image forming apparatus. The printer cartridge includes a cartridge body having a refillable reservoir and a heater mechanism. The refillable reservoir is adapted to receive developer particles suspended in a fluid medium. The heater mechanism heats the refillable reservoir to evaporate the fluid medium from the refillable reservoir leaving the developer particles behind.

BRIEF DESCRIPTION OF THE DRAWINGS

The accompanying drawings are included to provide a further understanding of the present invention. The drawings illustrate the embodiments of the present invention and together with the description serve to explain the principles of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION

Figure 1:
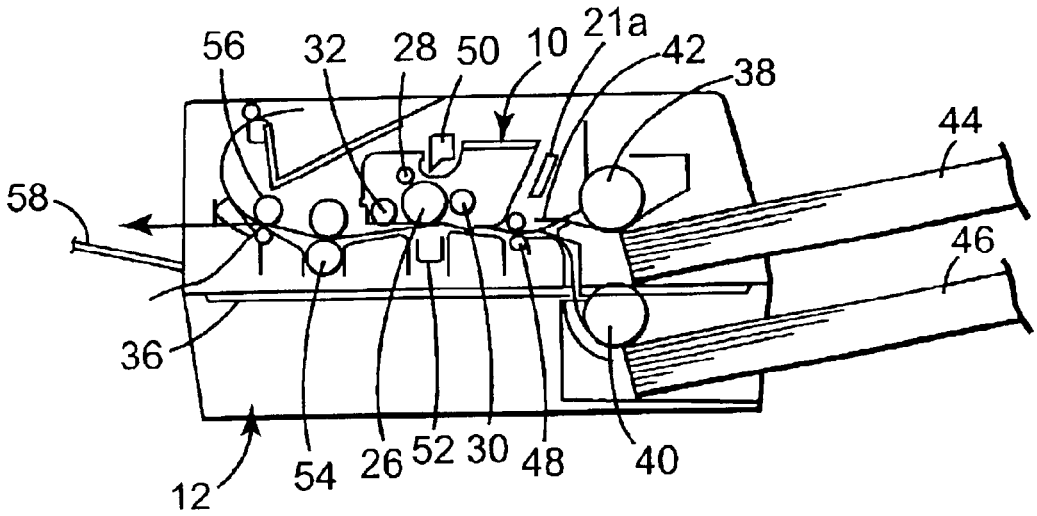
FIG. 1 is a simplified side sectional view of an image forming apparatus incorporating a refillable printer cartridge in accordance with one embodiment of the present invention.
Figure 2:
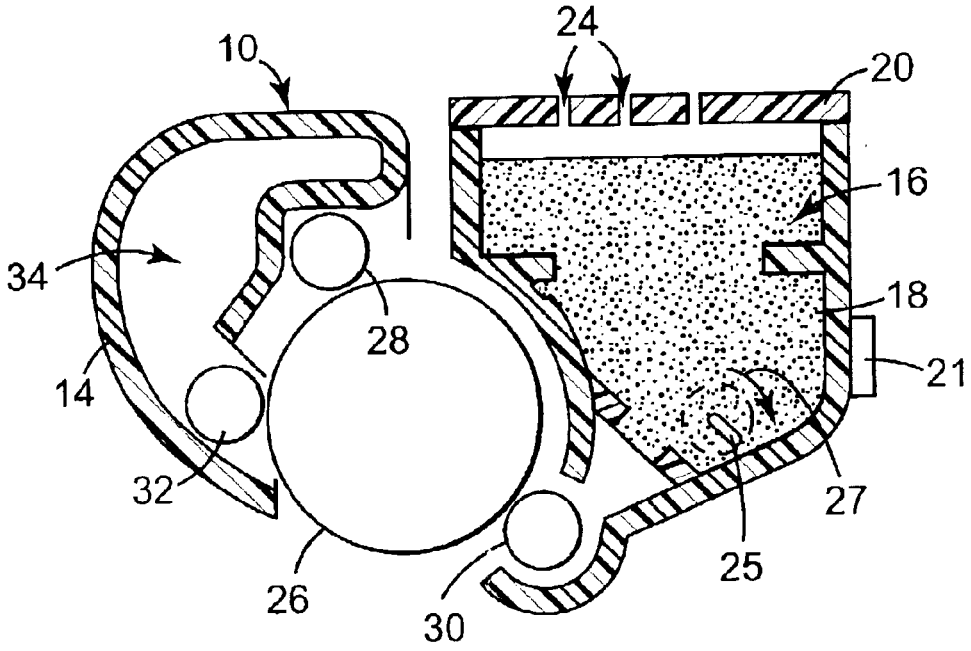
FIG. 2 is a simplified side sectional view of the refillable printer cartridge shown in FIG. 1.
Figure 3:
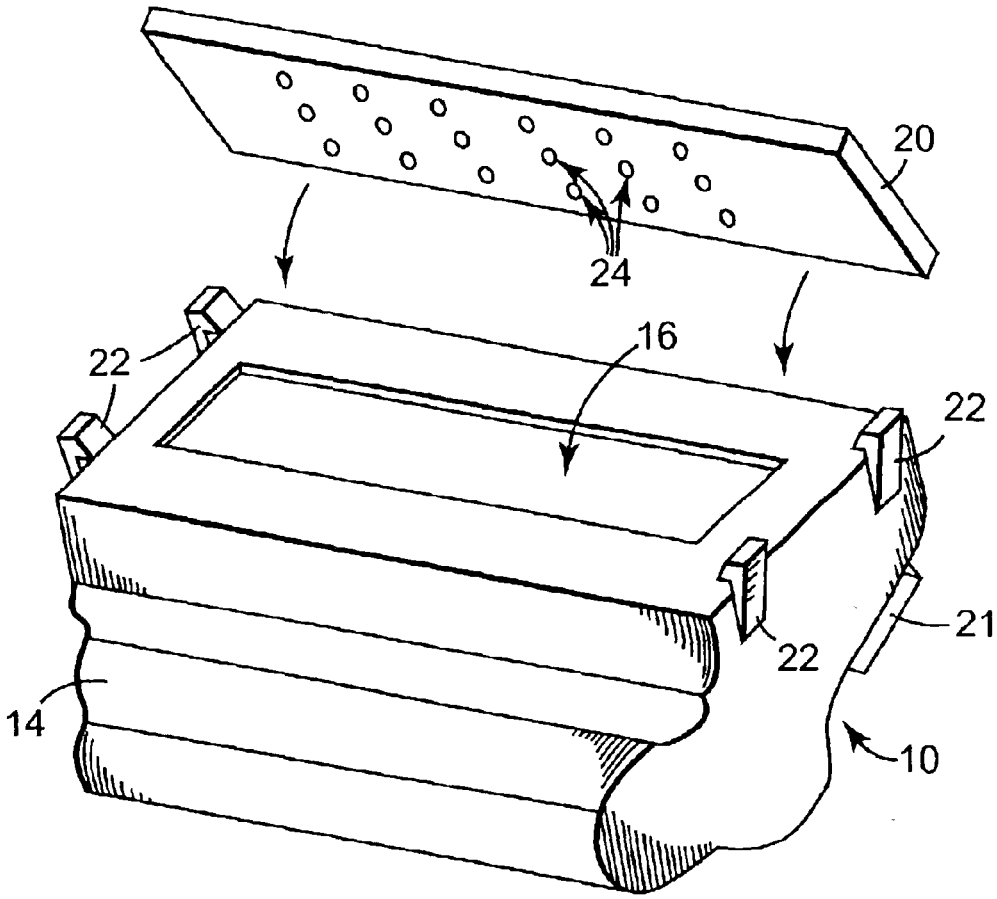
FIG. 3 is a simplified perspective view of the refillable printer cartridge shown in FIG. 2 with a filler cap of the refillable printer cartridge removed.

FIGS. 1–3 depict a refillable, printer (i.e., toner) cartridge 10 for an image forming apparatus 12, such as an electrophotographic printer, in accordance with one embodiment of the present invention. The printer cartridge 10 is readily removable from and can be readily inserted back into the image forming apparatus 12. The printer cartridge 10 includes a cartridge body 14 having a refillable reservoir 16 (i.e., hopper) shown containing dry developer particles, such as polymer based toner 18.

Access to the refillable reservoir 16 to refill the reservoir 16, as will be described more fully below, is accomplished through a readily removable and replaceable filler cap 20. The filler cap 20 is removably held in place via resilient snap clips 22 (see FIG. 3). The filler cap 20 includes a vent mechanism defined by spaced vent holes 24 that extend through the filler cap 20 and allow interior regions of the reservoir 16 to communicate with atmosphere. The purpose of the vent holes 24 will be explained more fully below. A heating mechanism defined by a heater element 21 is mounted to the cartridge body 14. The heater element 21 heats the contents of the refillable reservoir 16 which will be described more fully below. A movable toner agitator mechanism 25 is mounted to the cartridge body 14 so as to extend into the refillable reservoir 16. The toner agitator mechanism 25 is rotatable in the direction of arrow 27 to stir the toner 18 in order to maintain the powdery consistency of the toner 18. A further purpose of the toner agitator mechanism 25 will be explained more fully below.

The cartridge body 14 houses an electrophotographic photoreceptor member 26, a charging assembly 28 for electrostatically charging the photoreceptor member 26, a developing assembly 30 for using the toner 18 to develop a latent charged image on the photoreceptor member 26, a cleaning assembly 32 for removing toner 18 remaining on the photoreceptor member 26, and a removed toner chamber 34 for accommodating toner 18 removed from the photoreceptor member 26 by the cleaning assembly 32.

The image forming apparatus 12 includes a main assembly 36 having a feed assembly defined by feed rollers 38 and 40 for feeding sheets of print media 42 stacked in print media cassettes 44 and 46, and a pair of rollers 48 for conveying a sheet of print media 42 away from the print media cassettes 44, 46. The main assembly 36 further includes an exposure assembly 50 for forming the latent charged image on the photoreceptor member 26 after the photoreceptor member 26 has been charged by the charging assembly 28 of the printer cartridge 10. In addition, the main assembly 36 of the image forming apparatus 12 includes a transfer assembly defined by an electrostatic charger 52 for transferring the latent charged image that has been developed by the developing assembly 30 to the print media 42. A fixing assembly defined by a pair of heat rollers 54 fixes the developed latent image on the print media 42. A further pair of rollers 56, of the feed assembly, feeds the sheet of print media 42, with the fixed image thereon, to an output tray 58 of the image forming apparatus 12.

Figure 4A:
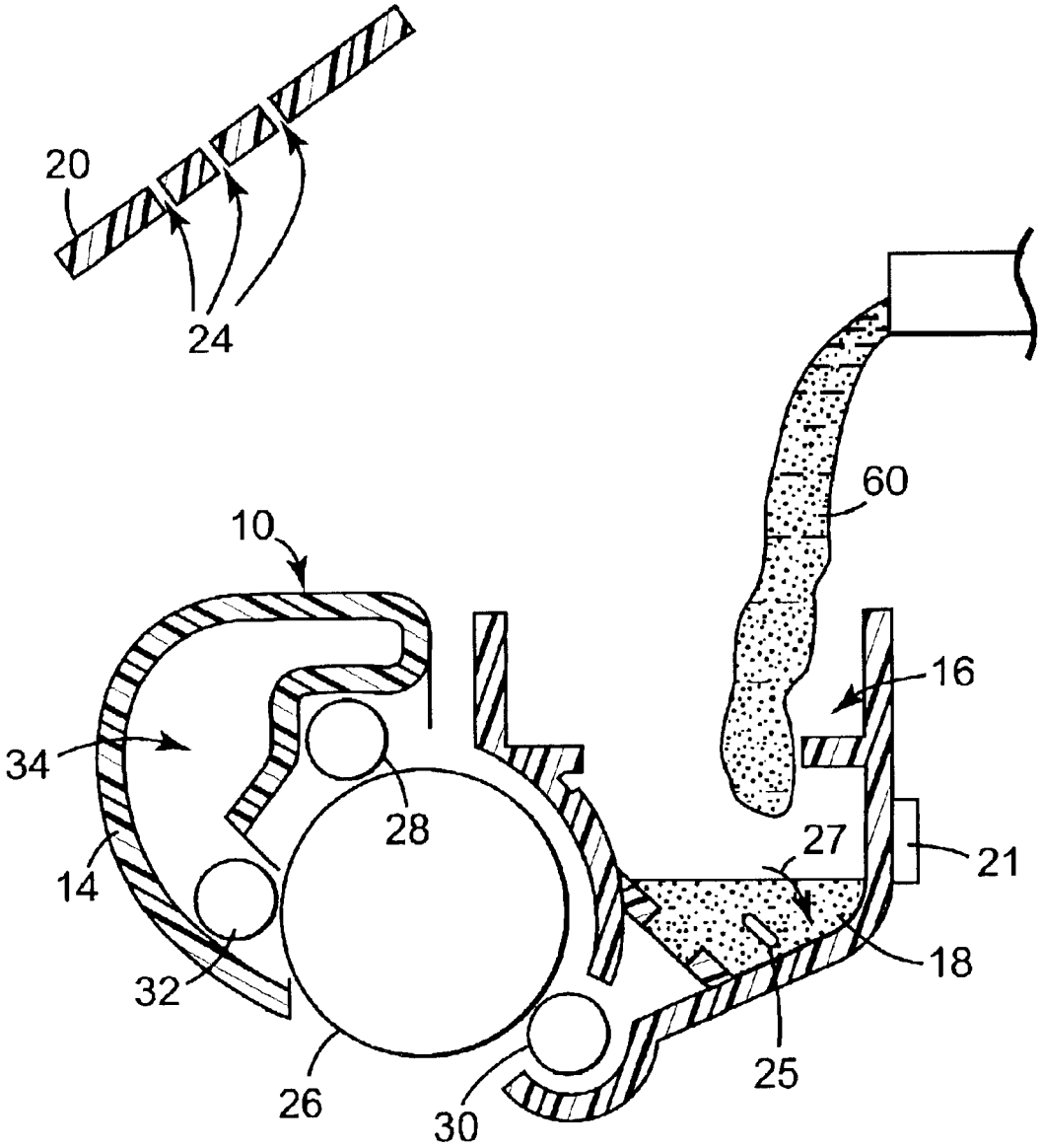
FIGS. 4A–4C are simplified side sectional views similar to FIG. 2 illustrating a method of refilling the refillable printer cartridge with developer particles suspended in a fluid medium in accordance with one embodiment of the present invention.
Figure 4B:
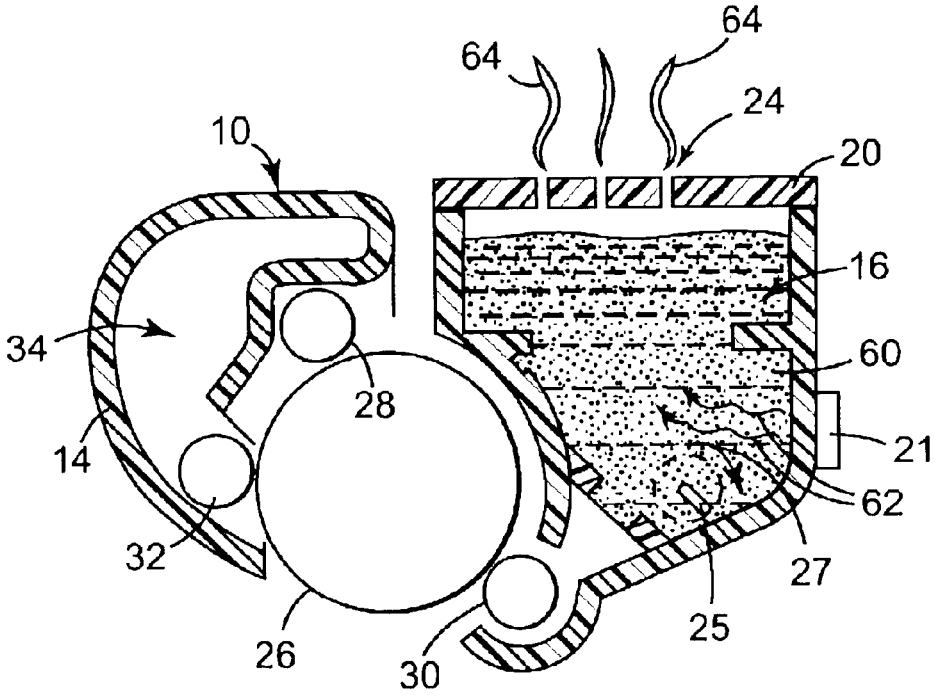
Figure 4C:
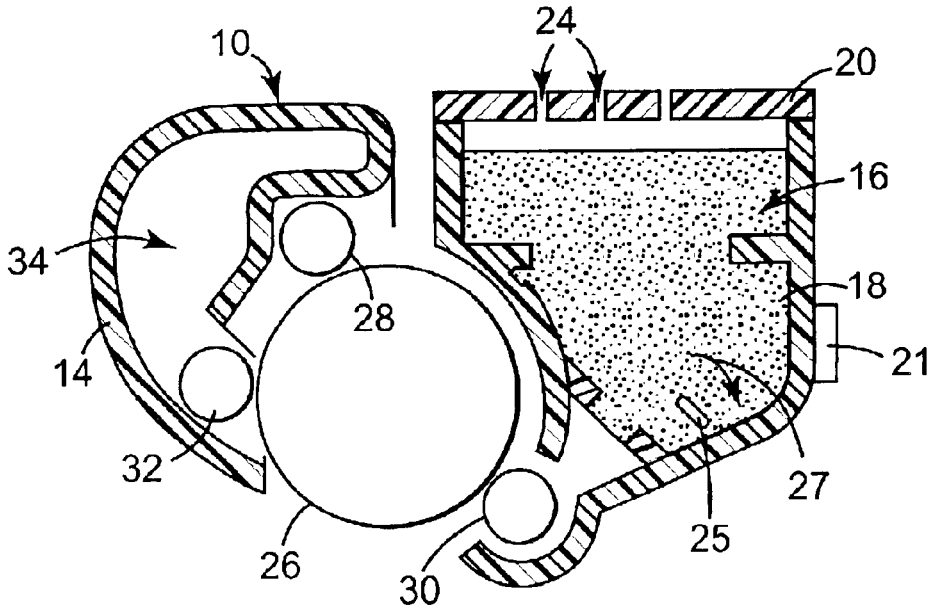

FIGS. 4A–4C are diagrams illustrating one exemplary embodiment of a method of refilling a refillable printer cartridge with developer particles suspended in a fluid medium according to the present invention. As seen in FIG. 4A, to refill a refillable reservoir 16 of a printer cartridge 10, which has at least been partially depleted of toner 18, the printer cartridge 10 is first removed from the main assembly 36 of the image forming apparatus 12, and the filler cap 20 is removed from the cartridge body 14 by flexing the snap clips 22 thereby exposing the refillable reservoir 16. Next, the refillable reservoir 16 is refilled with toner/fluid medium mix 60. This toner/fluid medium mix 60 consists of toner 18 which has been suspended in a fluid medium, such as water. For practical purposes, this toner/fluid medium mix 60 would be premixed by a manufacturer and then provided to a consumer for refilling of the print cartridge 10.

Since this toner/fluid medium mix 60 is a fluid, it does not exhibit the drawbacks normally associated with refilling of a print cartridge with toner in its fine powdery form. For example, since the toner/fluid medium mix 60 is a fluid it is easier to control during pouring and therefore does not tend to spill over the components of the printer cartridge. In addition, since the toner/fluid medium mix 60 is a fluid it does not tend to linger in the air. As a result, using the toner/fluid medium mix 60 to refill the reservoir 16 of the printer cartridge 10 is less likely to result in excess toner on the photoreceptor and the attendant blotching, streaking or voiding of prints and copies produced by the electrophotographic printing process when excess toner is present. Moreover, since the toner/fluid medium mix 60 is a fluid that can be more easily handled, toner spillage on moving parts of the toner cartridge, which can cause the moving parts to wear out more rapidly and may even short out the electrical components in the cartridge, is less likely to occur. In addition, since the toner/fluid medium mix 60 is a fluid which can be more easily handled, toner spillage as a result of the refilling process, which can reduce the quality of prints and copies, increase maintenance cost, and can even decrease the useful life of the image forming apparatus, is less likely to occur.

Next, as seen in FIG. 4B, once the refillable reservoir 16 is filled with the toner/fluid medium mix 60, the filler cap 20 is replaced on the cartridge body 14 to be held in place by the resilient snap clips 22. Then, the printer cartridge 10 containing the toner/fluid medium mix 60 is inserted back into the main assembly 36 of the image forming apparatus 12. Next, the heater element 21 is activated to produce heat 62. The heat 62 is of a temperature sufficient to change the fluid medium of the toner/fluid medium mix 60 to a gas 64. In other words, the heat 62 from the heater element 21 is sufficient to evaporate the fluid medium (i.e., water) from the toner/fluid medium mix 60 leaving only the toner 18 behind in the reservoir 16 of the printer cartridge 10. During the evaporation of the fluid medium from the toner/fluid medium mix 60, the evaporated fluid medium (i.e., gas) exits the refillable reservoir 16 through the vent holes 24 in the filler cap 20. In addition, during the evaporation of the fluid medium from the toner/fluid medium mix 60, the toner agitator mechanism 25 rotates in the direction of the arrow 27 to stir the toner/fluid medium mix 60 to insure that all of the fluid medium is evaporated leaving behind toner 18 having a fine powdery consistency. The toner agitator mechanism 25 can also operate after all of the fluid medium is evaporated (e.g., during the image forming process) to maintain the fine powdery consistency of the toner 18 in the reservoir 16. FIG. 4C illustrates the conclusion of the printer cartridge 10 refill process wherein all of the fluid medium (i.e., water) has been evaporated out of the toner/fluid medium mix 60 leaving only the toner 18 behind.

Although in one preferred embodiment the heater element 21 is mounted on the cartridge body 14 of the printer cartridge 10, alternatively, a heater element 21*a* could be mounted on the main assembly 36 of the image forming apparatus 12. In still another embodiment heat from the operation of one or more of the feed assembly (i.e., rollers 38, 40, 48, 56), exposure assembly 50, transfer assembly (i.e., electrostatic charger 52) and fixing assembly (heat rollers 54) could be used to evaporate the fluid medium from the toner/fluid medium mix 60 leaving the toner 18 behind in the refillable reservoir 16 of the printer cartridge 10.

Although the present invention has been described with reference to preferred embodiments, workers skilled in the art will recognize that changes may be made in form and detail without departing from the spirit and scope of the invention.

What is claimed is:

1. A printer cartridge for an image forming apparatus, the printer cartridge comprising:

a printer cartridge body;

a refillable reservoir within the printer cartridge body, the refillable reservoir adapted to receive developer particles suspended in a fluid medium; and a heater mechanism on the printer cartridge body for heating the refillable reservoir to evaporate the fluid medium from the refillable reservoir leaving the developer particles behind.

2. The printer cartridge of claim 1, and further including:

a vent mechanism on the cartridge body in communication with the refillable reservoir, the vent mechanism allowing the fluid medium to evaporate from the refillable reservoir upon application of heat by the heater mechanism.

3. A printer cartridge for an image forming apparatus, the printer cartridge comprising:

a cartridge body;

a refillable reservoir within the cartridge body, the refillable reservoir adapted to receive developer particles suspended in a fluid medium; and a heater mechanism on the cartridge body for heating the refillable reservoir to evaporate the fluid medium from the refillable reservoir leaving the developer particles behind, and further including;

a removable filler cap on the cartridge body for providing access to an interior region of the refillable reservoir, the filler cap when removed allowing the developer particles suspended in the fluid medium to be poured into the refillable reservoir.

4. The printer cartridge of claim 3 wherein the vent mechanism is located in the removable filler cap.

5. A printer cartridge for an image forming apparatus, the printer cartridge comprising:

a cartridge body;

a refillable reservoir within the cartridge body, the refillable reservoir adapted to receive developer particles suspended in a fluid medium; and a heater mechanism on the cartridge body for heating the refillable reservoir to evaporate the fluid medium from the refillable reservoir leaving the developer particles behind, and further including;

a removable filler cap on the cartridge body for providing access to an interior region of the refillable reservoir, the filler cap when removed allowing the developer particles suspended in the fluid medium to be poured into the refillable reservoir.

6. A printer cartridge for an image forming apparatus, the printer cartridge comprising:

a cartridge body;

a refillable reservoir within the cartridge body, the refillable reservoir adapted to receive developer particles suspended in a fluid medium; and a heater mechanism on the cartridge body for heating the refillable reservoir to evaporate the fluid medium from the refillable reservoir leaving the developer particles behind, and further including;

a movable agitator mechanism mounted to the cartridge body so as to extend into the refillable reservoir, the movable agitator mechanism operating to stir the developer particles suspended in the fluid medium while heat is applied to the refillable reservoir by the heater mechanism.

7. The printer mechanism of claim 6 wherein the movable agitator operates to stir the developer particles left behind after the fluid medium has evaporated off.

8. The printer cartridge of claim 1 wherein the developer particles are polymer based toner particles, and wherein the fluid medium is water.

9. A printer cartridge for an image forming apparatus, the printer cartridge comprising:

a cartridge body;

a refillable reservoir within the cartridge body, the refillable reservoir containing developer particles suspended in a fluid medium, wherein the fluid medium comprises a liquid; and a vent mechanism on the cartridge body in communication with the refillable reservoir, the vent mechanism configured to allow the fluid medium to evaporate from the refillable reservoir leaving the developer particles behind, and further including:

a removable filler cap on the cartridge body for providing access to an interior region of the refillable reservoir, the filler cap when removed allowing the developer particles suspended in the fluid medium to be poured into the refillable reservoir.

10. The printer cartridge of claim 9 wherein the vent mechanism is located in the removable filler cap.

11. A printer cartridge for an image forming apparatus, the printer cartridge comprising:

a cartridge body;

a refillable reservoir within the cartridge body, the refillable reservoir adapted to receive developer particles suspended in a fluid medium;

a vent mechanism on the cartridge body in communication with the refillable reservoir, the vent mechanism allowing the fluid medium to evaporate from the refillable reservoir leaving the developer particles behind, and further including;

a movable agitator mechanism mounted to the cartridge body so as to extend into the refillable reservoir, the movable agitator mechanism operating to stir the developer particles suspended in the fluid medium while heat is applied to the refillable reservoir by a heater mechanism.

12. The printer mechanism of claim 11 wherein the movable agitator operates to stir the developer particles left behind after the fluid medium has evaporated off.

13. A printer cartridge for an image forming apparatus, the printer cartridge comprising:

a printer cartridge body;

a refillable reservoir within the printer cartridge body, the refillable reservoir containing developer particles suspended in a fluid medium; and a vent mechanism on the cartridge body in communication with the refillable reservoir, the vent mechanism allowing the fluid medium to evaporate from the refillable reservoir leaving the developer particles behind, wherein the developer particles are polymer based toner particles, and wherein the fluid medium is water.

14. A printer cartridge for an image forming apparatus, the printer cartridge comprising:

a cartridge body;

a refillable reservoir within the cartridge body, the refillable reservoir containing developer particles suspended in a fluid medium, wherein the fluid medium comprises a liquid; and a vent mechanism on the cartridge body in communication with the refillable reservoir, the vent mechanism configured to allow the fluid medium to evaporate from the refillable reservoir leaving the developer particles behind wherein the cartridge body further includes:

an electrophotographic photoreceptor member;

a charging assembly for charging the photoreceptor member;

a developing assembly for using the developer particles, left behind in the refillable reservoir after the fluid medium has been evaporated, for developing a latent charged image on the photoreceptor member;

a cleaning assembly for removing developer particles remaining on the photoreceptor member; and a removed developer particle chamber for accommodating the developer particles removed from the photoreceptor member.

15. An apparatus for forming an image on print medium comprising:

a main assembly including a heating mechanism;

a refillable process cartridge detachably mountable to the main assembly, the refillable process cartridge including:

a cartridge body; and a refillable reservoir within the cartridge body, the refillable reservoir adapted to receive developer particles suspended in a fluid medium, the heating mechanism of the main assembly heating the refillable reservoir to evaporate the fluid medium from the refillable reservoir leaving the developer particles behind.

16. The image forming apparatus of claim 15 wherein the heating mechanism is a heater element mounted to the main assembly of the image forming apparatus.

17. The image forming apparatus of claim 15 wherein the main assembly includes components for forming the image on the print medium, and wherein these image forming components are the heating mechanism for heating the refillable reservoir to evaporate the fluid medium from the refillable reservoir leaving the developer particles behind.

18. The image forming apparatus of claim 15 wherein the cartridge body further includes:

an electrophotographic photoreceptor member;

a charging assembly for charging the photoreceptor member;

a developing assembly for using the developer particles, left behind in the refillable reservoir after the fluid medium has been evaporated, for developing a latent charged image on the photoreceptor member;

a cleaning assembly for removing developer particles remaining on the photoreceptor member; and a removed developer particle chamber for accommodating the developer particles removed from the photoreceptor member.

19. The image forming apparatus of claim 18, and further including:

a feed assembly for moving the print medium within the main assembly;

an exposure assembly for forming the latent charged image on the photoreceptor member;

a transfer assembly for transferring the developed latent charged image from the photoreceptor member to the print media; and a fixing assembly for fixing the developed latent image on the print media, wherein at least one of the feed, exposure, transfer and fixing assemblies defines the heating mechanism for heating the refillable reservoir to evaporate the fluid medium from the refillable reservoir leaving the developer particles behind.

20. The image forming apparatus of claim 15, and further including:

a vent mechanism on the cartridge body in communication with the refillable reservoir, the vent mechanism allowing the fluid medium to evaporate from the refillable reservoir upon application of heat by the heating mechanism.

21. The image forming apparatus of claim 20, and further including:

a removable filler cap on the cartridge body for providing access to an interior region of the refillable reservoir, the filler cap when removed allowing the developer particles suspended in the fluid medium to be poured into the refillable reservoir, wherein the vent mechanism is located in the removable filler cap.

22. The image forming apparatus of claim 15, further including:

a movable agitator mechanism mounted to the cartridge body so as to extend into the refillable reservoir, the movable agitator mechanism operating to stir the developer particles suspended in the fluid medium while heat is applied to the refillable reservoir by the heating mechanism.

23. A method of refilling a removable printer cartridge of an image forming apparatus that has at least been partially depleted of developer particles, the method comprising:

refilling a refillable reservoir of the printer cartridge with developer particles suspended in a fluid medium; and heating the refillable reservoir to evaporate the fluid medium from the refillable reservoir leaving the developer particles behind.

24. The method of refilling the printer cartridge of claim 23 wherein the step of heating the refillable reservoir includes:

heating the refillable reservoir with a heater element mounted on the printer cartridge.

25. The method of refilling the printer cartridge of claim 23 wherein the step of heating the refillable reservoir includes:

heating the refillable reservoir with a heater element mounted on the image forming apparatus.

26. The method of refilling the printer cartridge of claim 23 wherein the image forming apparatus includes components for forming images on print media, and wherein the step of heating the refillable reservoir includes:

heating the refillable reservoir with a heat supplied by the operation of the image forming components of the image forming apparatus.

27. The method of refilling the printer cartridge of claim 23 wherein the step of heating the refillable reservoir includes:

stirring the developer particles suspended in the fluid medium while heating the refillable reservoir to evaporate the fluid medium from the refillable reservoir leaving the developer particles behind.

28. The method of refilling the printer cartridge of claim 23 wherein the step of heating the refillable reservoir includes:

heating the refillable reservoir to evaporate the fluid medium from the refillable reservoir leaving the developer particles behind while venting the evaporated fluid medium through a vent mechanism on the printer cartridge.

29. The method of refilling the printer cartridge of claim 23 wherein the step of heating the refillable reservoir includes:

heating the refillable reservoir to evaporate the fluid medium from the refillable reservoir leaving the developer particles behind while venting the evaporated fluid medium through a vent mechanism on the printer cartridge and stirring the developer particles suspended in the fluid medium.

* * * * *